United States Patent [19]

le Duc

[11] Patent Number: 4,903,558

[45] Date of Patent: Feb. 27, 1990

[54] SLIP-JOINT PLIERS

[76] Inventor: Don le Duc, 2405 Alvarado Dr., Santa Clara, Calif. 95051

[21] Appl. No.: 319,358

[22] Filed: Mar. 6, 1989

[51] Int. Cl.[4] ..... B25B 7/06

[52] U.S. Cl. ..... 81/416; 81/417

[58] Field of Search ..... 81/416, 417, 415

[56] References Cited

U.S. PATENT DOCUMENTS

| | | | |
|---|---|---|---|
| 65,162 | 5/1867 | Brown | 81/129 |
| 172,239 | 1/1876 | Barlow | 81/129 |
| 172,241 | 1/1876 | Barlow | 81/129 |
| 198,264 | 12/1877 | Barlow | 81/129 |
| 482,198 | 9/1892 | Ryan | 81/129 |
| 597,101 | 1/1898 | Collings | 81/129 |
| 957,560 | 5/1917 | Holt | 81/412 |
| 1,236,138 | 8/1917 | Bernard | 81/412 |
| 1,657,348 | 1/1928 | Drumm | 81/417 |
| 1,715,426 | 7/1927 | Peterson | 81/129 |
| 1,763,527 | 6/1930 | Jones | 81/417 |
| 4,669,340 | 6/1987 | Igarashi | 81/417 |

FOREIGN PATENT DOCUMENTS

| | | | |
|---|---|---|---|
| 1029806 | 12/1950 | France | 81/129 |
| 108568 | of 1938 | Sweden | 81/129 |

*Primary Examiner*—Frederick R. Schmidt
*Assistant Examiner*—Lawrence Cruz

[57] ABSTRACT

Slip-joint pliers of the two-position jaw adjustment type and adjusted by a method of pivot pin through slots shifting in the inoperative positions of the pliers, and settings maintained by interference of opposing plier body elements and in which the pivot pin remains on the respective center lines of the tool in the operative positions resulting in a cooperative geometry for spring loading the plier handles and enabling the plier jaws to fully clamp as well as have the tool cut materials in both jaw adjusted positions, the spring loaded handles set, prior to initiated spring resistance, so that the cutting elements are lined up, ready to start cutting as an alternative to visual alignment only, of the cutters.

2 Claims, 3 Drawing Sheets

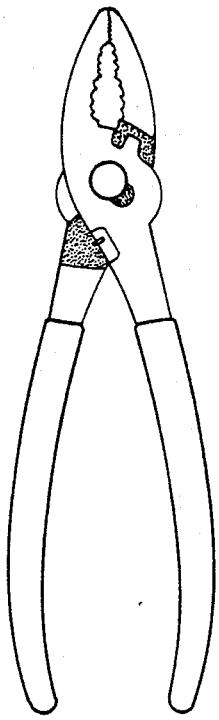
FIG. 1
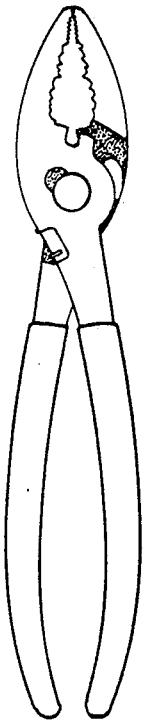
FIG. 2
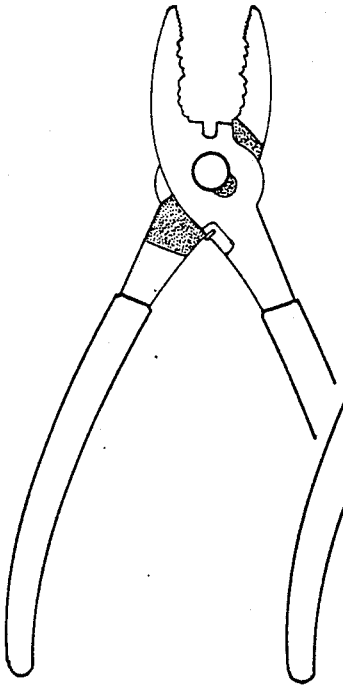
FIG. 3
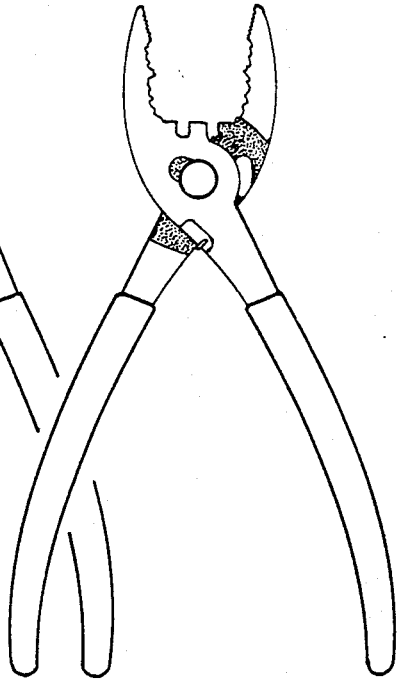
FIG. 4
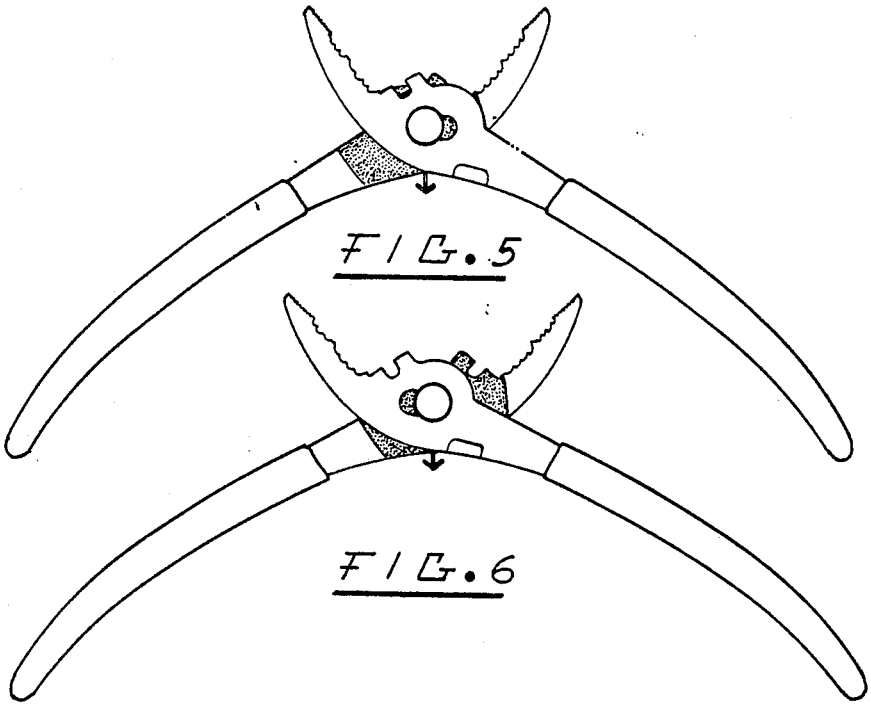
FIG. 5
FIG. 6

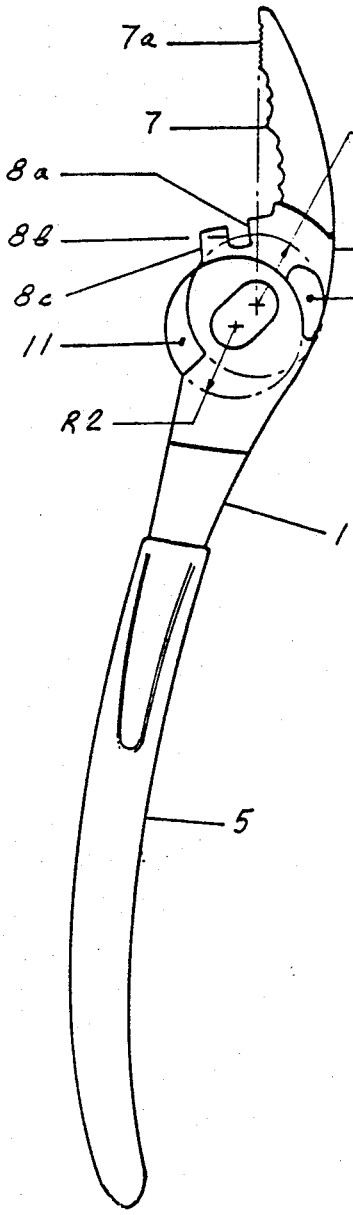
FIG. 13
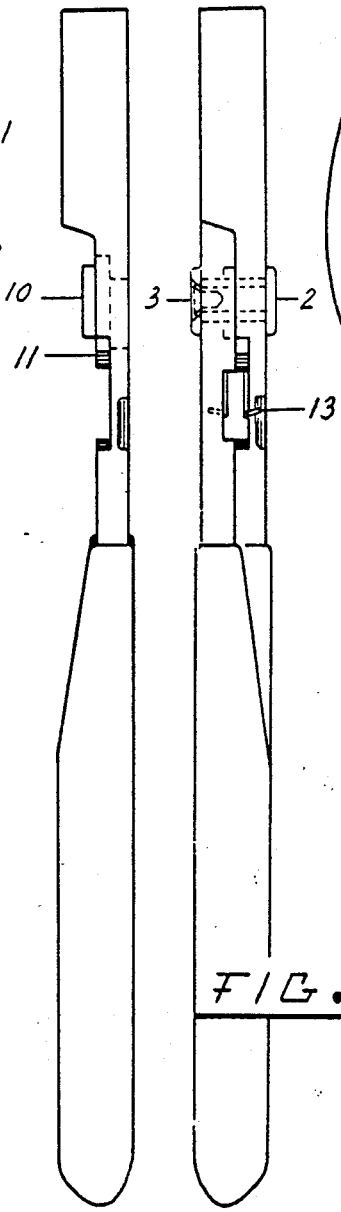
FIG. 14
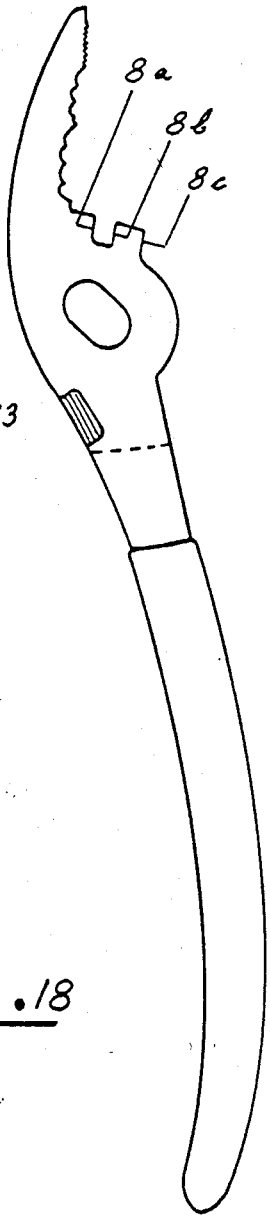
FIG. 15
FIG. 18
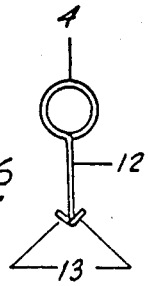
FIG. 16
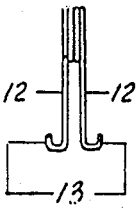
FIG. 17

SLIP-JOINT PLIERS

BACKGROUND OF THE INVENTION

The present invention relates to slip-joint pliers of the type generally referred to as combination pliers, because of their included ability to cut wire.

In the standard configuration the pliers consist of two handle members, adjustable to two jaw positions by means of a shiftable bolt of one member pivoting inside a slot of the other member. The threaded, for a nut, shoulder bolt has a shoulder portion that is flattened on two opposite sides.

The length of the portion is slightly less than the combined thickness of the two members in the pivot area. A double-D shaped hole in one member receives the bolt and rotation is prevented. The slot is shaped like and open, on center, figure 8 that permits the flattened section to slip through the narrowed down slot. In this manner two pivot centers are established, some short distance apart.

Applying pressure on the plier handles forces the pivot pin against the minimal material at the narrowed passage of the slot in the direction of the other end of the slot. Push combined with torque result in wear and enlargement in this area and binding of the pin is an early sign of the wearing process. Breakthrough of the pin is postponed by the selection of higher grade forging materials. The pivot pin proposed in my new pivot geometry is round without flats, thereby stronger, and bears against the ends of normally shaped slots and thus increases bearing areas by 300 percent. The now slotted plier members are identical and consequently favourably effect factory assembly, staging, part movement, inventory, forging dies, single part tooling (holding fixtures), identical and simplified punches that will have longer life if the tool material is lowered in hardness, which is now made possible by the increase in pin bearing surfaces.

The standard pivot geometry makes the tool non-symmetrical and for that reason inherits three drawbacks that most people have learned to live with, because a solution is entirely not obvious.

The first drawback is that in the widest adjusted position, from now on called Position 2, the tips of the jaws will not come together so that pinching is not possible here.

The second drawback is that wire cannot be cut in Position 2 because the cutters don't line up.

The third drawback is that all attempts known to me, to make the pliers spring-loaded for improved operator's grip and control have been awkward, cumbersome and non-cooperative to satisfy both adjusted positions equally.

One notable exception is revealed in U.S. Pat. No. 4,669,340 which only suffers from increased cost due to the need for machining the forged members, each one of which in a different way.

The present invention is intended to overcome the aforementioned limitations of the prior art by providing a pivot geometry wherein the pivot remains centered for both adjusted positions and which then makes the construction and installation of a handle/jaw assist spring a viable proposition.

SUMMARY OF THE INVENTION

Accordingly, it is an object of the invention to provide an improved slip-joint pliers and to provide such pliers with useable jaw tips in the second adjusted position.

Another object of the invention is to provide wire cutting ability for both positions at a point when the handles become spring-loaded as an automatic aid in lining up the cutters.

A further object is to provide a simplified pivot pin with nut and pivot adjustment slot arrangement and with improved strength characteristics by the elimination of weak points of the standard design.

Still another object of the invention is to provide a simple spring, including installation for biasing the jaws and handles to sufficient and convenient spreads for closing and handle grip.

A still further object is to exclude the spring force in the changeover from adjusted positions for unhindered operator's ease.

A final object is to accomplish all of the above without the need for additional machining.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, it's construction and operation, and many of it's advantages should be readily understood and appreciated.

To avoid repetitious statements, FIGS. 1 through 12 are side elevations of the tool and in which the two pivots positions are called Pos. 1 and Pos. 2. Position 1 sets the jaws to the narrow position and position 2 sets the jaws to the wide position.

FIGS. 1 through 6 prove the claims made of the behaviour of the handles and FIGS. 7 through 12 clearly illustrate the interlocking features of the assembled tool in enlarged detail.

FIGS. 1 and 7 show the tool in Pos. 1.

FIGS. 2 and 8 show the tool in Pos. 2.

FIGS. 3 and 9 show the tool in Pos. 1 with the handles becoming spring-loaded.

FIGS. 4 and 10 show the tool in Pos. 2 with the handles becoming spring-loaded.

FIGS. 5 and 11 show the tool in Pos. 1 ready for jaw closure or for shifting to Pos. 2.

FIGS. 6 and 12 show the tool in Pos. 2 ready for jaw closure or for shifting to Pos. 1.

FIG. 13 shows the interior side of a typical plier member.

FIG. 14 is a side elevation of FIG. 13.

FIG. 15 is the exterior side of the plier member.

FIG. 16 is a detail of the handle torsion spring.

FIG. 17 is a side elevation of FIG. 16.

FIG. 18 is a plan view of the pliers assembled.

DESCRIPTION OF THE PREFERRED EMBODIMENT

The tool consists of two identical plier members 1, placed upon one another in a scissor-like fashion in the assembly, a bolt 2 and nut 3 in FIG. 18 and a torsion spring 4 slipped over the bolt diameter and installed internally.

Figure 7:
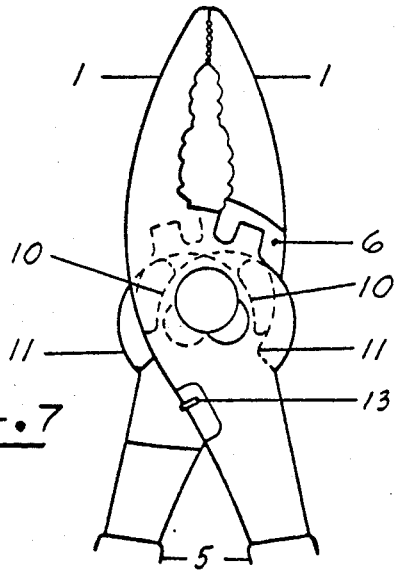
Figure 8:
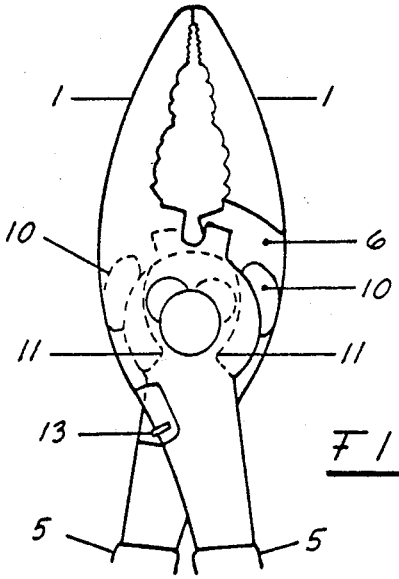
Figure 9:
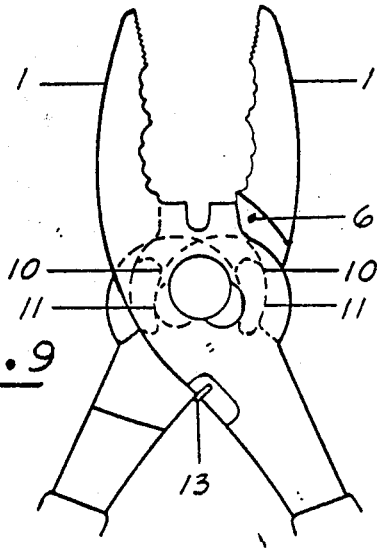
Figure 10:
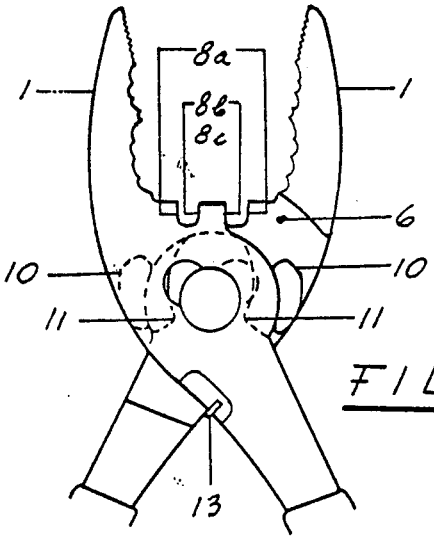

Plier member 1 has a handle portion 5 connected to an intermediate portion 6 and a work engaging jaw 7 extended from the intermediate portion opposite the handle portion. Sharpened edges 8*a*, 8*b* and 8*c* are added to the intermediate portion for wire cutting. Strategic placement of these edges results in cut-off features to line up with each other in both adjusted positions as is seen in FIGS. 3, 4, 9 and 10. At these points of jaw settings it will be noted that the handle spreads are identical and are assured of those positions by the interference of the torsion spring at the intersection of the inside edges of the handle portions.

The intermediate portion is recessed to form raised and sunk elements 10 and 11 that cooperate with each other in a tongue and groove-like manner. The height and depth of these elements are nominally equal in order to have flat surfaces slide against each other in the assembly. A slot is punched in member 1 at approximately 45 degrees offset angularly from the working surface 7*a* at the end of the jaw. The length of the slot is decided by center lines 9*a* and 9*b*. The raised and sunk elements 10 and 11 are defined by radii R1 and R2 drawn from these centers, respectively.

Formed from this are crescent-like ribs 10 and 11. These ribs prevent the two handle members from moving to or from the pivot bolt in both adjusted positions.

Rib 11 acts as a male connector in that its body is raised above the level of that of rib 10.

Figure 11:
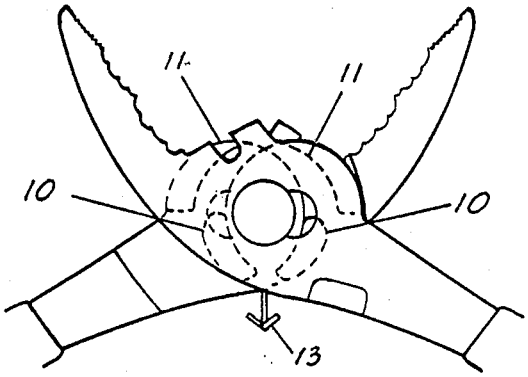
Figure 12:
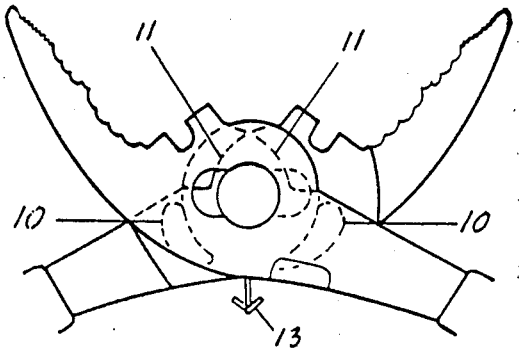

Torsion spring 4 is of a symmetrical shape and after two or three windings has its arms 12 project outwardly and in parallel relationship, the extreme ends of which are curled around to form hook-like fingers 13 which latch onto the inner edges of the handle portions with further closing of the handles. Separating the handles to positions as in FIGS. 5, 6, 11 and 12 move the pivot slots in line so that inward or outward shifting of the handles is possible because ribs 10 and 11 have moved around and out of each others way.

Having fully described the invention, what I claim as new, and desire to secure by Letters Patent of the United States, is:

1. Pliers comprising two identical plier members for scissor-like assembly, a pivot bolt with nut, a torsion spring for biasing the members, and two jaw adjustment positions;

said plier member having a handle portion, an intermediate portion for the pivot bolt, nut and spring mounting and terminating into work engaging jaws;

said intermediate portion provided with a slot offset at an angle of approximately 45 degrees from a substantially straight work engaging surface at the tip of said jaw;

said intermediate portion recessed to form raised and sunk elements, the elements of one member abutting the elements of the other member in an interlocking manner;

said elements defined by radii drawn from center lines of said slot to form a pair of crescent-shaped ribs, one on each side of the slot, one rib elevated above the other by the first rib's height;

said intermediate portion provided with wire cutting edges to form wire cutting elements for both jaw adjusted positions;

said torsion spring wound to slide and mount over the pivot bolt, it's ends terminating into hooks for positive latching with the inner edges of the handle portions, the moment of latching coinciding with a line-up of said cutting elements of said plier members in both jaw adjusted positions.

2. Pliers comprising two identical plier members for scissor-like assembly, a pivot bolt with nut, a torsion spring for biasing the members, and two jaw adjusted positions;

said plier members having a handle portion, an intermediate portion for the pivot bolt, nut and spring mounting and terminating into work engaging jaws;

said intermediate portion provided with a slot offset at an angle of approximately 45 degrees from a substantially straight work engaging surface at the tip of said jaw;

said intermediate portion recessed to form raised and sunk elements, the elements of one member abutting the elements of the other member in an interlocking manner;

said elements defined by radii drawn from center lines of said slot to form a pair of crescent-shaped ribs, one on each side of the slot, one rib elevated above the other by the first rib's height;

said torsion spring wound to slide and mount over the pivot bolt, it's ends terminating into hooks for positive latching with the inner edges of the handle portions.

* * * * *

UNITED STATES PATENT AND TRADEMARK OFFICE

CERTIFICATE OF CORRECTION

PATENT NO. : 4,903,558

DATED : Febuary 27, 1990

INVENTOR(S) : Le Duc

It is certified that error appears in the above-identified patent and that said Letters Patent is hereby corrected as shown below:

On the title page item [56] References cited under U.S. Patent Documents, delete --U.S. Patent Documents:

| | | | |
|---|---|---|---|
| 65,162 | 05/1867 | Brown | 81/129 |
| 172,239 | 01/1876 | Barlow | 81/129 |
| 172,241 | 01/1876 | Barlow | 81/129 |
| 198,264 | 12/1877 | Barlow | 81/129 |
| 482,198 | 09/1892 | Ryan | 81/129 |
| 597,101 | 01/1898 | Collins | 81/129 |
| 1,715,426 | 07/1927 | Peterson | 81/129 |

Foreign Patent Documents:

| | | | |
|---|---|---|---|
| 1029806 | 12/1950 | France | 81/129 |
| 108568 | of 1938 | Sweden | 81/129 |

Signed and Sealed this

Fifteenth Day of January, 1991

*Attest:*

HARRY F. MANBECK, JR.

*Attesting Officer*

*Commissioner of Patents and Trademarks*